US007866661B2

(12) United States Patent
Fairweather et al.

(10) Patent No.: US 7,866,661 B2
(45) Date of Patent: Jan. 11, 2011

(54) SHEET/PAGE BUFFER FOR SHEET HANDLING APPARATUS

(75) Inventors: James A. Fairweather, Milford, CT (US); Thomas M. Lyga, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 804 days.

(21) Appl. No.: 11/846,741

(22) Filed: Aug. 29, 2007

(65) Prior Publication Data

US 2009/0057974 A1 Mar. 5, 2009

(51) Int. Cl.
*B65H 29/00* (2006.01)

(52) U.S. Cl. ..... 271/186; 271/184; 271/185

(58) Field of Classification Search ..... 271/184, 271/185, 186, 258.02; 270/39.09, 58.06
See application file for complete search history.

(56) References Cited

U.S. PATENT DOCUMENTS 4,516,866 A * 5/1985 Yamauchi et al. ..... 400/25
4,700,497 A * 10/1987 Sato et al. ..... 40/531
4,916,493 A * 4/1990 DeVito ..... 399/402
5,183,347 A * 2/1993 Higuchi et al. ..... 400/583.3
5,186,453 A * 2/1993 Kuhnert ..... 271/270
5,303,017 A * 4/1994 Smith ..... 399/403
5,462,268 A * 10/1995 Remy et al. ..... 271/225
5,737,988 A * 4/1998 Krupica et al. ..... 83/367
6,286,831 B1 * 9/2001 Marasco et al. ..... 271/303
6,976,673 B2 * 12/2005 Madsen ..... 271/186
7,305,921 B2 * 12/2007 Scholzig et al. ..... 101/232
7,706,737 B2 * 4/2010 Lang ..... 399/397
2004/0251605 A1 * 12/2004 Hsieh ..... 271/186

* cited by examiner

*Primary Examiner*—Stefanos Karmis
*Assistant Examiner*—Howard Sanders
(74) *Attorney, Agent, or Firm*—Brian A. Collins; Angelo N. Chaclas; Steven J. Shapiro

(57) ABSTRACT

A page buffer for receiving and holding, in queue, pages prepared by a printer and subsequently processed by mail-piece inserter. The page buffer includes pairs of vertically-aligned rollers defining a plurality of page stations therebetween. Each pair of rollers is spaced-apart and defines a nip for driving printed pages along a feed path. Furthermore, each page station is defined by and between a first pair of rollers disposed downstream of an adjacent second pair of rollers. A drive means is also provided for independently driving the pairs of vertically-aligned rollers. The drive means is controlled such that, in a first operating mode, the pairs cooperate to drive printed pages along the feed path. In a second operating mode, the drive means is controlled such that at least one of the page stations causes its respective first pair of rollers to retain and hold a leading edge portion of a printed page while the adjacent second pair drives and releases a trailing edge portion of the printed page. The printed page is, therefore, held within the page station such that the trailing edge droops below the feed path in a predominantly vertical orientation.

23 Claims, 9 Drawing Sheets

SHEET/PAGE BUFFER FOR SHEET HANDLING APPARATUS

TECHNICAL FIELD

The present invention relates to systems which buffer sheet material in advance or upstream of a sheet handling apparatus, and more particularly, to a sheet/page buffer for a mail creation system which receives, holds and delivers sheet material to and from an upstream printer and downstream mailpiece inserter.

BACKGROUND OF THE INVENTION

A mail creation system or a "mailpiece inserter" is commonly employed for producing mailpieces intended for mass mail communications. Such mailpiece inserters are typically used by organizations such as banks, insurance companies and utility companies for producing a large volume of specific mail communications where the contents of each mailpiece are directed to a particular addressee. Also, other organizations, such as direct mailers, use mailpiece inserters for producing mass mailings where the contents of each mailpiece are substantially identical with respect to each addressee.

In many respects, a typical inserter resembles a manufacturing assembly line. Sheets and/or other raw materials (i.e., a web of paper stock, enclosures, and envelopes) enter the inserter as inputs. Various modules or workstations of the inserter work cooperatively to process the sheets until a finished mail piece is produced. Typically, inserter systems prepare mail pieces by arranging preprinted sheets of material into a collation, i.e., the content material of the mail piece, on a transport deck. The collation of preprinted sheets may continue to a chassis module where additional sheets or inserts may be added based upon predefined criteria, e.g., an insert being sent to addressees in a particular geographic region. Subsequently, the collation may be folded and placed into envelopes. Once filled, the envelopes may be closed, sealed, weighed, and/or sorted. A postage meter may then be used to apply postage indicia based upon the weight and/or size of the mail piece.

These inserters typically require the use of "preprinted" sheets which are presented to the various downstream devices by a feed module for subsequent processing. That is, a mailpiece job run is printed to produce an "ordered" stack of mailpiece content material which may be fed to the mailpiece inserter. Scan codes disposed in the margin of the first or last sheet of each mailpiece document provide the instructions necessary to process the mailpiece, i.e., whether additional inserts will be added, how the content material is to be folded (C-fold, Z-fold, etc.) and/or what size envelop will the content material be contained. To facilitate communication of these instructions, a user computer and a printing device are typically network-connected to the mailpiece inserter such that scan codes can be easily printed and interpreted.

More recently, printers have been integrated with mailpiece inserters so that mailpiece content material may be supplied "on-demand", and/or "just-in-time". Examples of inserters having integrated printers include the DI 900 and DI 950 desktop mailpiece inserters manufactured by Pitney Bowes Inc., located in Stamford, Conn. To facilitate throughput, a sheet or page buffer is commonly employed between the printer and inserter modules. In FIG. 1, a conventional page buffer 100 is schematically depicted and interposed between a printer 110 and a chassis module of a mailpiece inserter 112. The page buffer 100 communicates with a system controller 114 to monitor/track the throughput of pages

116 processed by the mailpiece inserter 112. Specifically, the page buffer 100 receives printed pages 116 from the printer 110 and includes a plurality of sequential page stations 118*a*, 118*b*, 118*c*, 118*d*, 118*e* disposed along a serial feed path. Position sensing devices 120 are located at or along each of the page stations 118*a*, 118*b*, 118*c*, 118*d*, 118*e* to monitor the rate that printed pages 116 enter or leave the page buffer 100. Further, the sensing devices 120 are operative to issue position signals 122 to the system controller 114 such that the inserter 110 may determine whether a page or sheet 116 is positioned at a particular one of the page stations 118*a*, 118*b*, 118*c*, 118*d*, 118*e* or whether the page station is available for receipt of another printed page 116.

The rate of change of the position signals 122 (i.e., the signals issued by the page buffer 100) may be used by the controller 114 to determine the throughput that content material is processed. Fundamentally, the "throughput" or "throughput rate" is the magnitude at which sheet material is processed, whether in terms of a steady number of "sheets per unit time", bundles of sheets (e.g., bundles of five (5) sheets requested every several seconds) or a non-steady flow of sheets. Generally, it is the objective of the system controller 114 to drive the printer 110 to generate content material, i.e., printed pages 116 at a rate consistent, or commensurate, with the rate of processing by other downstream devices of the mailpiece inserter 112. Therefore, as pages are processed by the inserter 112, the controller 114 issues a request signal 124 to the printer 112 to generate additional pages 116.

The design of a page buffer is influenced by a variety of factors including: (i) the space envelope (i.e., length and height availability) of a mailpiece (ii) the number of page stations desired/required, (iii) the travel/conveyor distance from the printer to the inserter, (iv) the processing or throughput speed of the printer as compared to the inserter (i.e., can one module print/process pages faster, slower or at the same rate as the other module), and (v) other unique requirements such as whether pages must be inverted as a result of duplex or dual-sided printing. With respect to the page buffer described above, five (5) page stations are employed and spaced serially end-to-end. Assuming that the page stations accommodate conventional 8.5"×11.0" letter-size pages, the minimum conveyer or feed path length is approximately five feet (5'), i.e., five times the length of each station.

The page buffer 100 described above accommodates the length of the feed path by incorporating an upper turn-around section 100T, i.e., a vertical portion extending above the printer 110. However, should the design envelope of the page buffer not facilitate or accommodate the upper turn-around section 100T, or require additional page stations, (i.e., the addition of two (2) or three (3) page stations for a total of eight (8) stations), the total length of the feed path may preclude this design option. Even when the design envelope accommodates the overall increase to the page buffer dimensions, the length of the conveyer can impact other design parameters such as the speed, power and acoustics required and/or generated by the page buffer. That is, as the length of the feed path, i.e., from the output tray of the printer to the entrance of the inserter, increases, the conveyer speed must also increase to transport pages in the same time interval. As a consequence, the speed, power and acoustics can exceed threshold levels which place yet other limitations on the design of the page buffer.

In addition to the factors discussed in the preceding paragraph, the throughput capacity of the printer must be compatible, or made compatible, with the throughput of the inserter. In addition to the processing speeds of the respective modules, other factors such as the number of pages being processed at a particular point in time must be considered. For example, any time that the printer is processing pages, other pages, internal to the printer are being processed, including duplex or dual-sided pages. As a consequence, the page buffer must also accommodate or be prepared to queue pages "in process". As printers process pages at a higher rate, i.e., process more pages on a "per unit time basis", page buffers must accommodate the additional throughput.

A need, therefore, exists for a page buffer which minimizes the space envelope, reduces the length traveled by, i.e., the feed path of, a printed sheet, and optimizes the number of page stations available for printed pages to be processed by a mailpiece inserter.

SUMMARY OF THE INVENTION

A page buffer is provided for receiving and holding, in queue, pages prepared by a printer and subsequently processed by mailpiece inserter. The page buffer includes pairs of vertically-aligned rollers defining a plurality of page stations therebetween. Each pair of rollers is spaced-apart and defines a nip for driving the printed pages along a feed path. Furthermore, each page station is defined by and between a first pair of rollers disposed downstream of an adjacent second pair of rollers. A drive means is also provided for independently driving the pairs of vertically-aligned rollers. The drive means is controlled such that, in a first operating mode, the pairs cooperate to drive printed pages along the feed path. In a second operating mode, the drive means is controlled such that at least one of the page stations causes its respective first pair of rollers to retain and hold a leading edge portion of a printed page while the adjacent second pair drives and releases a trailing edge portion of the printed page. The printed page is, therefore, held within the page station such that the trailing edge droops below the feed path in a predominantly vertical orientation.

BRIEF DESCRIPTION OF THE DRAWINGS

The accompanying drawings illustrate a presently preferred embodiment of the invention and, together with the general description given above and the detailed description given below, serve to explain the principles of the invention. As shown throughout the drawings, like reference numerals designate like or corresponding parts.

BEST MODE TO CARRY OUT THE INVENTION

The inventive page buffer and method for controlling the same are described in the context of a mailpiece inserter system, though the inventive page buffer and control methodology may be used in combination with any sheet handling device which requires that sheet material or pages be held in a queue for subsequent processing. Further, the invention is described in the context of a DI 900 Model Mailpiece Inserter, i.e., a mailpiece creation system produced by Pitney Bowes Inc., located in Stamford, State of Connecticut, USA, though, the inventive subject matter may be employed in any mailpiece inserter.

Figure 1:
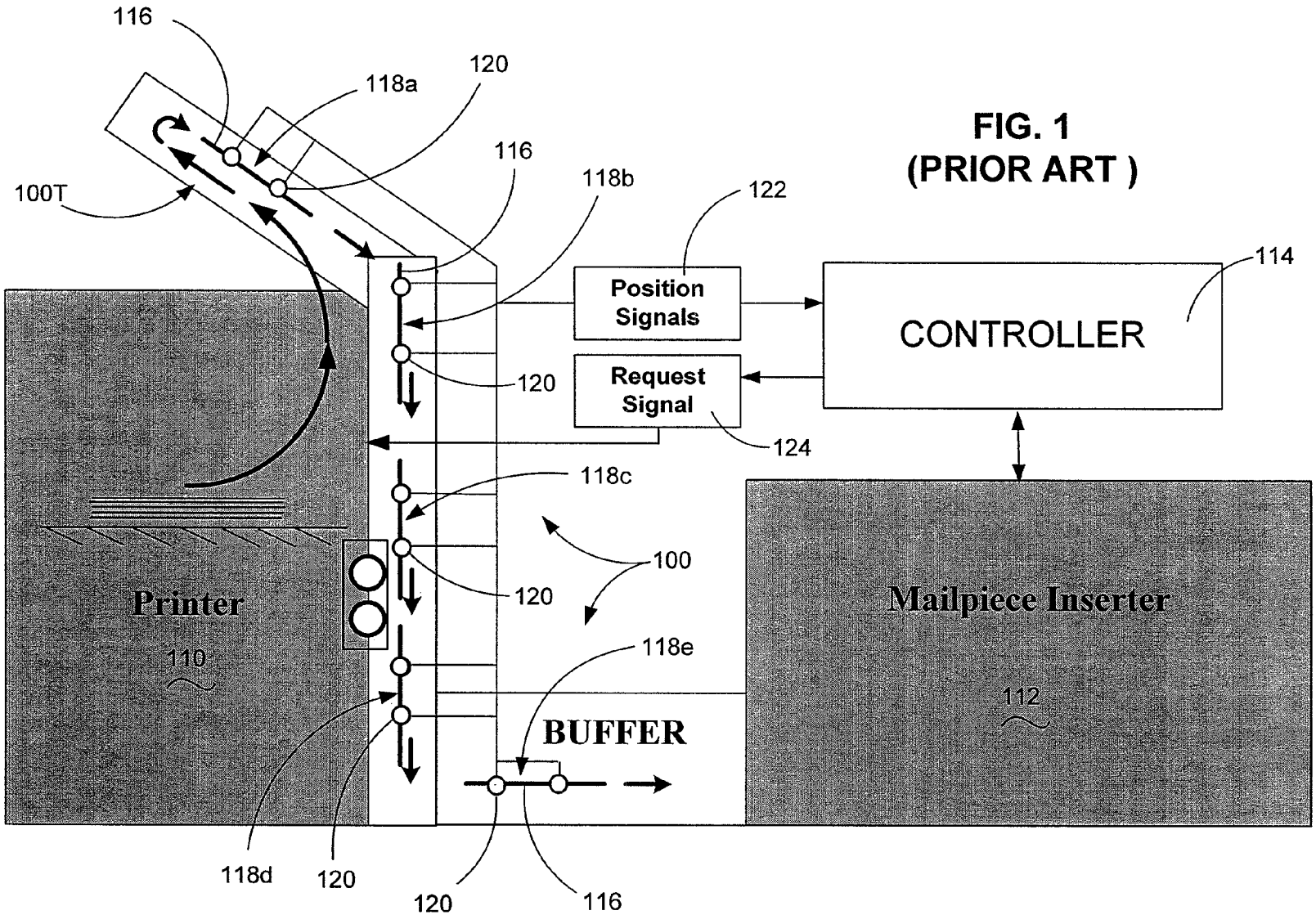
FIG. 1 (PRIOR ART)
FIG. 1 is a schematic side view of a prior art page buffer interposed between a printer and mailpiece inserter wherein the page buffer employs a plurality of in-line page stations which are disposed end-to-end in a serial arrangement.
Figure 2:
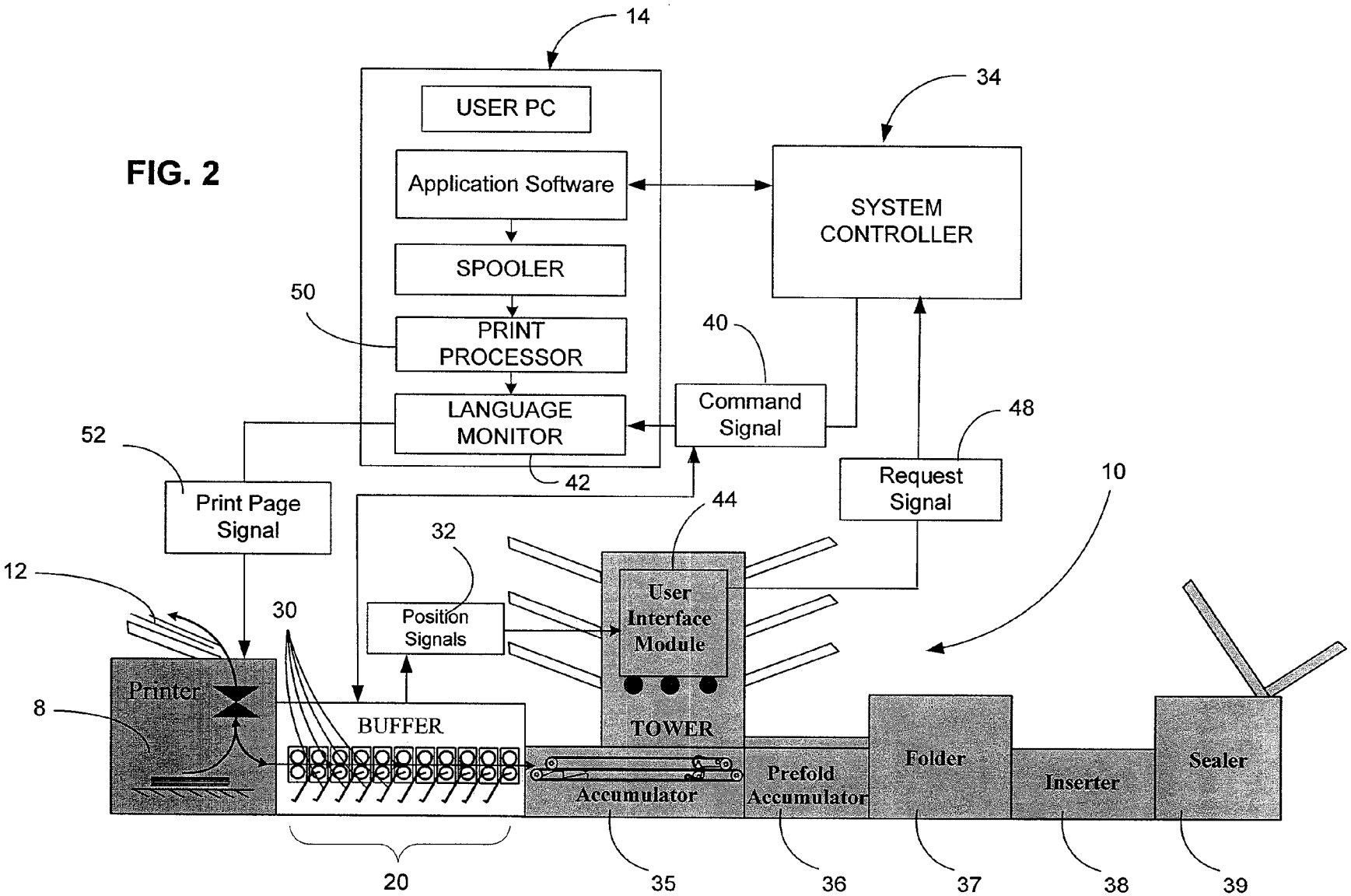
FIG. 2 is a schematic view of a desktop mailpiece inserter having a printer integrated with a mailpiece inserter and a page buffer according to the present invention interposed between the printer and inserter.

Before discussing the invention in greater detail, it will be useful to understand the basic system architecture and operation of the mailpiece inserter 10, including the cooperation of various system components and elements. In FIG. 2, a dedicated printer 8 is integrated with the mailpiece inserter 10 and is disposed upstream of various inserter devices (also referred to as "downstream devices" when the discussion/description is relative to the printer 8) which handle and process the mailpiece content material 12. Throughout the description, the terms "mailpiece content material", "printed pages", "printed material", "sheets" and/or "sheet material" will used interchangeably. In the described embodiment, an HP 4350 and HP 4700 model printer, manufactured by Hewlett Packard (HP), is integrated with the mailpiece inserter 10. The HP 4350 printer system is a black & white printer having an output rate of approximately fifty-five (55) pages per minute. The HP 4700 is a color printer having an output rate of approximately thirty (30) pages per minute.

In FIGS. 2 and 3*a*, a page buffer 20 according to the present invention is disposed downstream of the printer 8 and, inter alia, functions to accept, temporarily hold, and subsequently deliver printed pages 12 to the mailpiece inserter 10 for processing. More specifically, the page buffer 20 receives printed pages 12 from the printer 8 and includes a plurality of page stations 30 (discussed in greater detail hereinafter) disposed along the feed path i.e., between the printer 8 and the mailpiece inserter 10. The page stations 30 receive and hold content material 12 in a queue station (one page in each station) until a request is made by the inserter 10 that one or more printed pages 12 are needed, i.e., to be released.

The page buffer 20 includes position sensing devices, (not shown) located at or along each of the page stations 30, to monitor the rate that printed pages enter or leave the page buffer 20. Furthermore, the sensing devices are operative to issue position signals 32 to a system controller 34 such that the inserter 10 may determine whether a page or sheet 12 is positioned at a particular one of the page stations 30. In the described embodiment, the sensing devices are photocells, though any position sensor may be employed.

The rate of change of the position signals 32 (i.e., the signals issued by the page buffer 20) may be used by the controller 34 to determine the throughput of the inserter 10. Fundamentally, the "throughput" or "throughput rate" is the magnitude at which sheet material 12 is processed, whether in terms of a steady number of "sheets per unit time", bundles of sheets (e.g., bundles of five (5) or ten (10) sheets requested every several seconds) or a non-steady flow of sheets. Generally, it is the objective of the system controller 34 to drive the printer 8 at a rate consistent, or commensurate, with the rate of processing by other downstream devices of the mailpiece creation system 10. While in the described embodiment the initial/first downstream device is a page buffer 20, it should be appreciated that any downstream device may be adapted to issue a throughput signal indicative of a processing rate. In FIG. 2, such downstream devices may additionally, or alternatively, include an accumulator 35, a pre-fold accumulator 36, a folder 37, an envelop inserter 38, and/or a sealer 39.

The system controller 34 monitors the throughput data and issues command signals 40 indicative of the number of pages 12 to be printed by the integrated printer 8. More specifically, the command signals 40 are indicative of a specific page number to begin printing along with the number of pages 12 to follow. For example, the controller 34 may issue a command signal 40 which requests the printer 8 to generate page number thirty (Page #30) plus five (5) additional pages of data. Before this request is issued to the printer 8 (in the more conventional sense), the controller 34 issues the command through a page-based language monitor 42. In the preferred embodiment, the system controller 34 generally issues command signals 40 to print between three (3) and seven (7) pages with each request, though several command signals 40 may be generated within a very short period of time.

The mailpiece inserter 10 further includes a User Interface Module (UIM) 44 interposing the page buffer 20 and the system controller 34. The UIM 44 is responsive to the position signals 32 of the page buffer 20 for determining when additional pages, sheets of content material 12, can be accepted by the page buffer 20. Specifically, the UIM 44 is operative to issue request signals 48 to the system controller 34, i.e., the request signals 48 to print additional pages 12. Hence, conversion of the position signals 32 to command signals 40 may be performed by either the system controller 34 or by the UIM 44, depending upon where the program logic/intelligence is located. It should be further appreciated that while the request signal 48 may be made by the UIM 44, the controller 24 may have received a message that the print job, i.e., determined at the User PC 14, is complete. Consequently, in this instance, the controller 34 will not forward a command signal 40 to the language monitor 42 for issuance to the printer 8.

The page-based language monitor 42 (hereinafter the "language monitor" or "LM") receives print stream data from a page-based print processor 50 and is interposed between the system controller 34 and the dedicated printer 8. In the broadest sense, the LM 42 is the gate-keeper of data communicated to the printer 8 from the controller 34. More specifically, the LM 42 retains material content data, including an object-data dictionary, for each page of material content and triggers the printer 8 to generate a particular page (i.e., page number) along with N number of additional pages. While this request to print is made by the system controller 34, the LM 42 contains the active program code which intercepts the print stream data, i.e., the print control language (PCL), from the printer driver to throttle the rate at which content material 12 is generated by the printer 8.

More specifically, the page-based LM 34 is operative to vary the flow of print stream data to the printer 8 and vary the production rate of mailpiece content material. Additionally, the LM 42 includes a bufferfile capable of storing 300 MB (300,000,000 bytes) of data and, accordingly, the buffer file is capable of storing multiple pages of data, including duplex pages. Hence, in the context used herein, a "page" of data includes all data which may be found on a one-or two-sided sheet of paper.

In operation, the language monitor 42 and print processor 50 issue a print command signal 52 to throttle/control the output of the printer 8 in order to be consistent with or match the throughput of the mailpiece inserter 10. As more pages are processed by the inserter 10, additional or more frequent requests for additional printed pages 12 can be made. Should the inserter 10 require additional processing time to collate and/or combine a complex variety of inserts, requests can be made for a fewer number of printed pages or at less frequent intervals to prevent an overload condition or too many sheets from being printed over a prescribed period of time.

Figure 3:
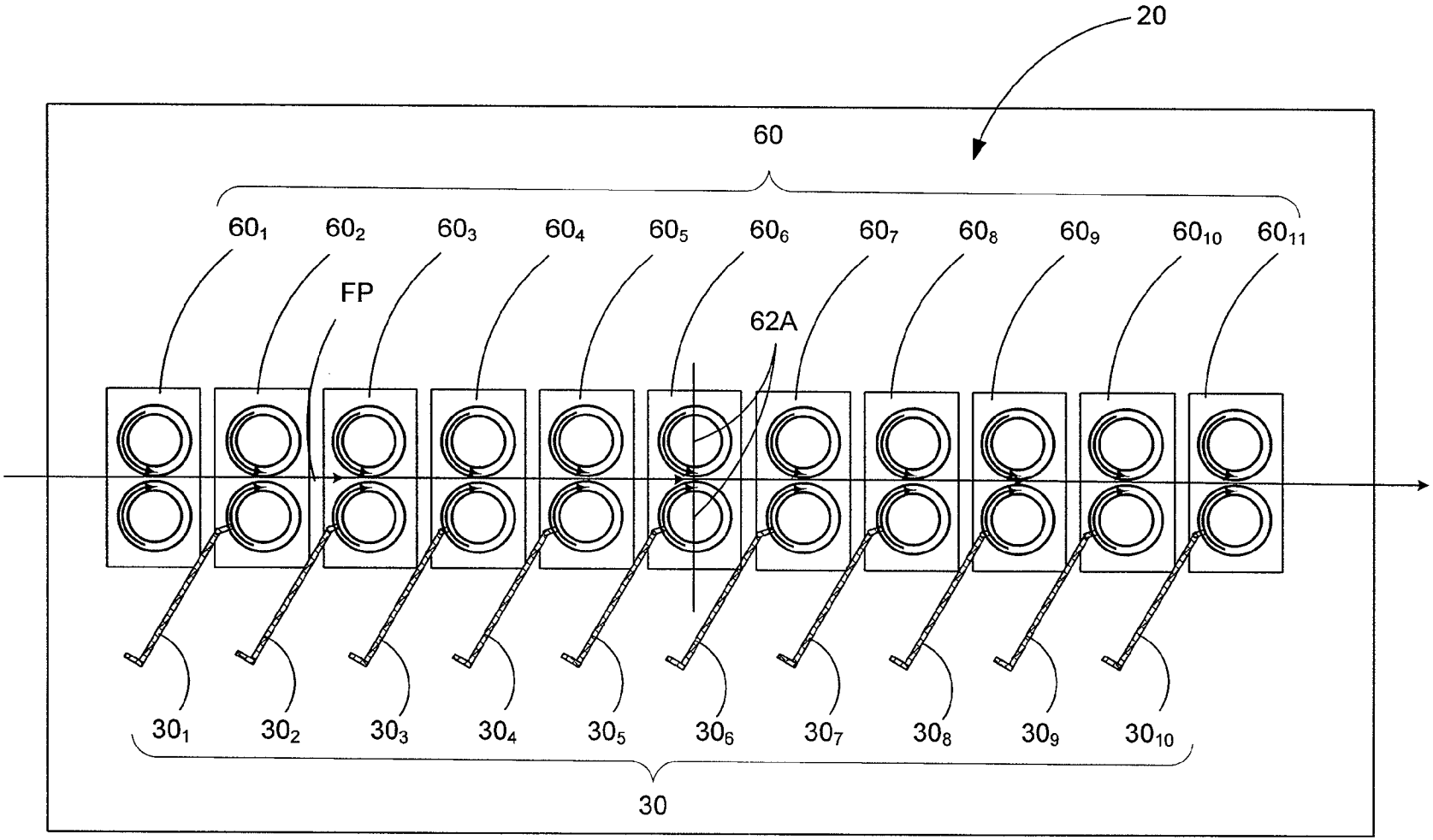
FIG. 3 depicts an isolated schematic view of the page buffer including a plurality of rolling elements or pairs of rollers operative to rapidly convey sheet material from one end to another and/or temporarily store the sheet material in one or more page stations disposed between the pairs of rollers.

In FIG. 3, the page buffer 20 includes pairs of vertically-aligned rollers 60 (hereinafter referred to as "pairs of rollers" or simply "pairs") which define a plurality of page stations 30 therebetween. In the context used herein "vertically-aligned" means that the rotational axes 62A of each pair are substantially vertically oriented. While the nip between the pairs 60 drives sheet material along a substantially horizontal feed path FP, the feed path FP may be inclined or declined depending upon the relative height between the printer and mailpiece inserter. In the illustrated embodiment, eleven (11) pairs of rollers $\mathbf{60}_1, \mathbf{60}_2 \ldots \mathbf{60}_{11}$ are depicted defining a total of ten (10) page stations $\mathbf{30}_1, \mathbf{30}_2 \ldots \mathbf{30}_{10}$ therebetween, though the page buffer 20 may contain as few as three (3) page stations or as many as twenty (20) depending, inter alia, upon the throughput capacity of the printer.

While the page stations 30 lie between adjacent pairs of rollers 60, i.e., between, for example, an upstream pair $\mathbf{60}_2$ and a downstream pair $\mathbf{60}_3$, the page stations 30 also lie below the feed path FP in a predominantly vertical orientation. In the context used herein "predominantly vertical orientation" means that that page stations extend vertically downward by a dimension less than about the length of a printed page. The horizontal distance or distance from one page station to an adjacent station, e.g., from $\mathbf{30}_1$ to $\mathbf{30}_2$ should preferably be less than about one-half the length of the printed page. Furthermore, the page stations 30 are essentially face-to-face. The significance of the spatial orientation and the method for loading and unloading the page stations will become clear in subsequent paragraphs.

Figure 4A:
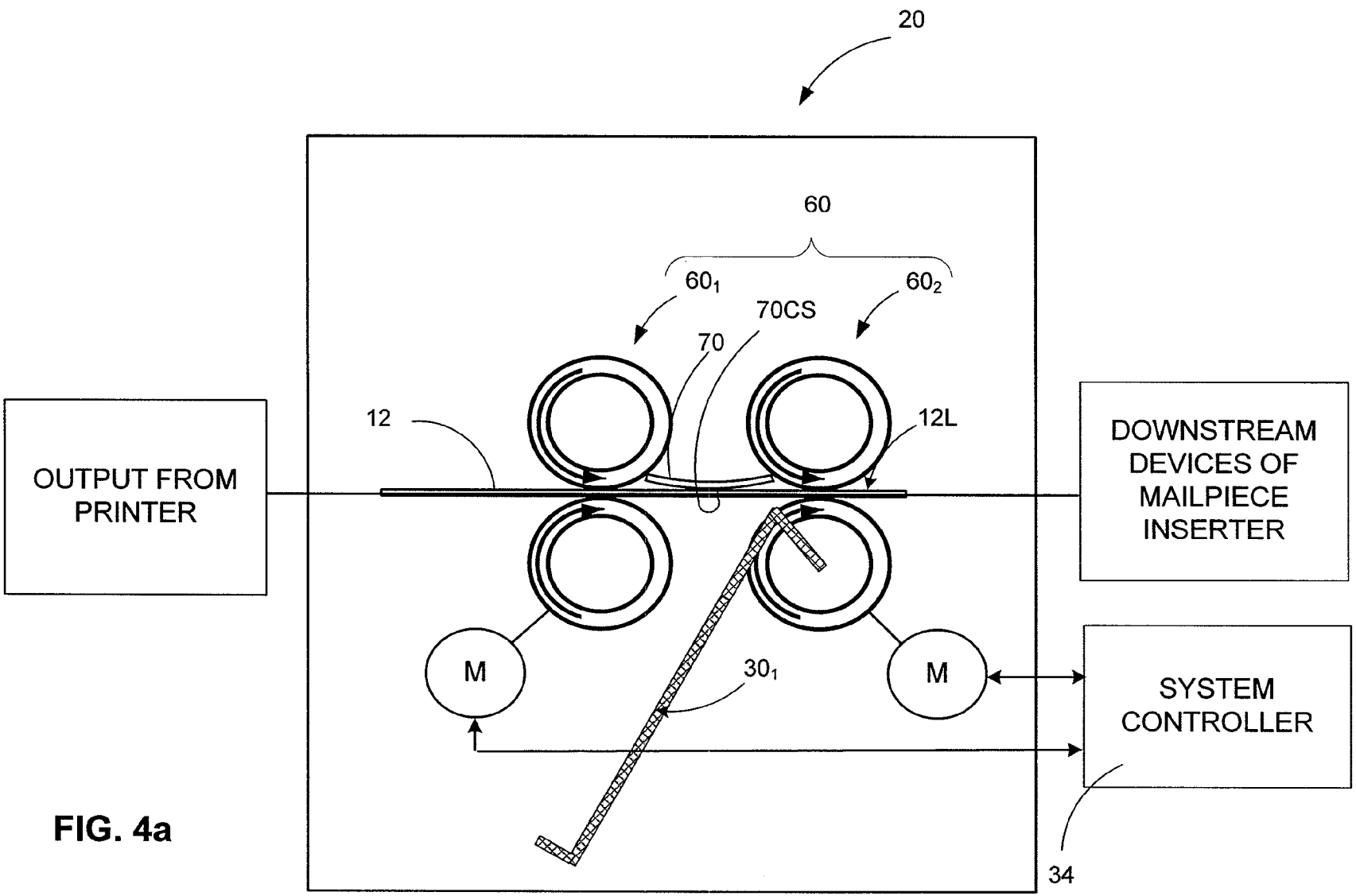
FIG. 4*a* depicts an enlarged view of a single page station including two adjacent pairs of rollers operative to capture a leading and trailing edge portion of a sheet of mailpiece content material.
Figure 4B:
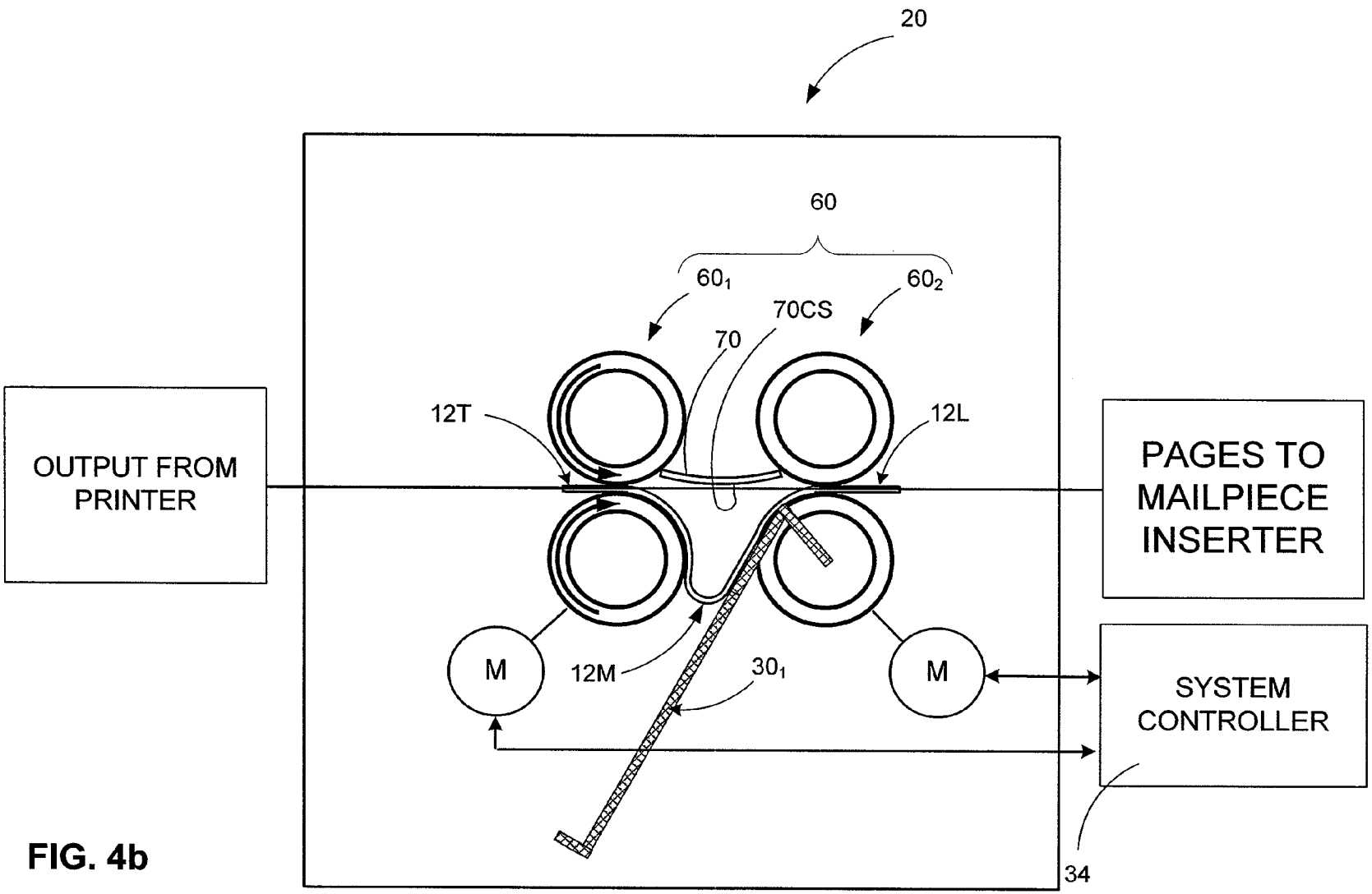
FIG. 4*b* depicts the page station shown in FIG. 4*a* wherein the downstream rollers capture the leading edge portion of the sheet while the upstream rollers drive the trailing edge portion thereof such that a midportion buckles downwardly to change the orientation of the sheet.
Figure 4C:
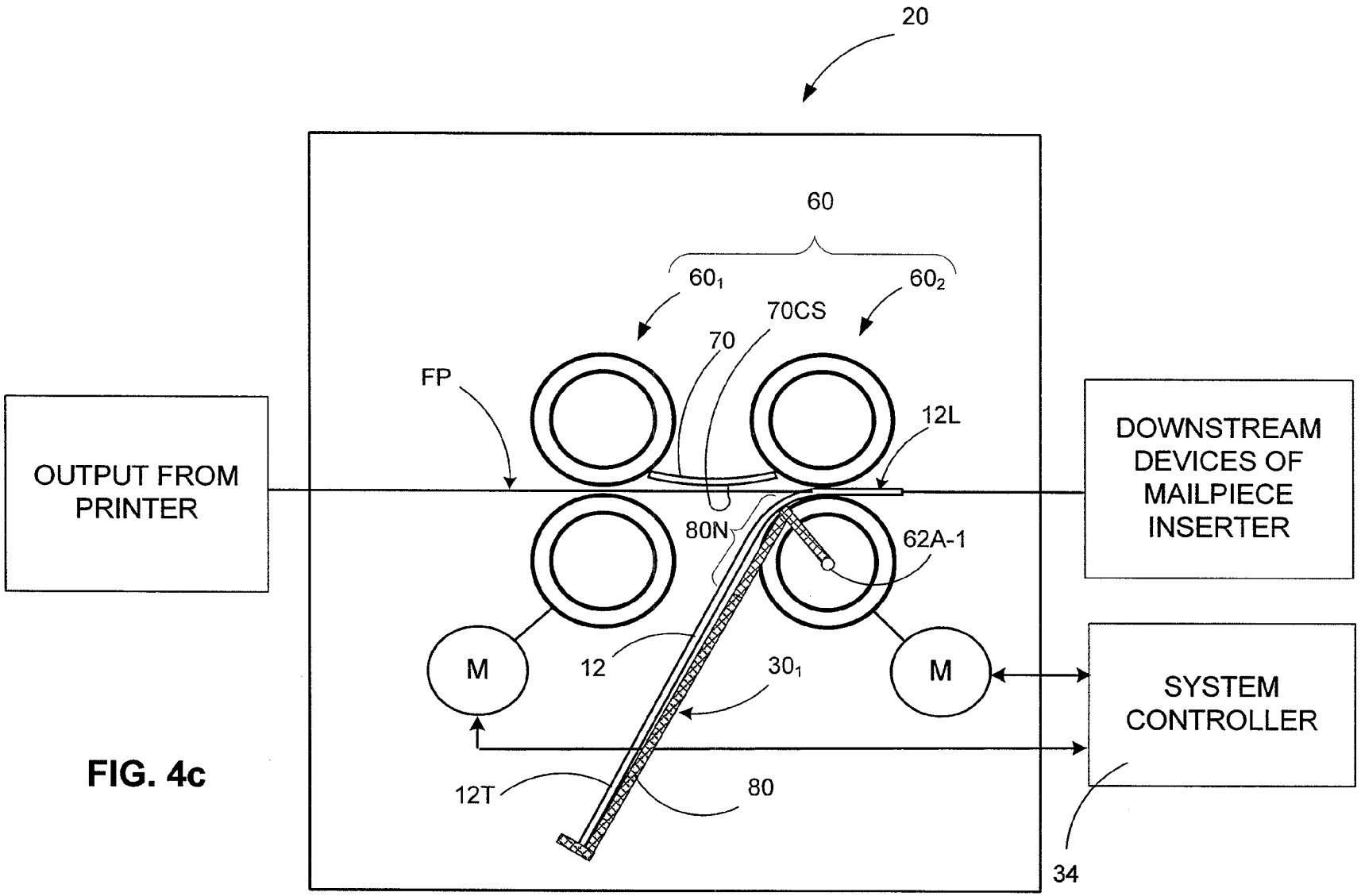
FIG. 4*c* depicts the page station shown in FIG. 4*a* wherein the upstream rollers drive and release the sheet such that the trailing edge thereof droops below the feed path in a predominantly vertical orientation.

FIGS. 4*a*, 4*b* and 4*c* depict the operation and control of two adjacent pairs of rollers $\mathbf{60}_1$, $\mathbf{60}_2$ to capture and temporarily hold or "buffer" a printed page 12 in a single page station $\mathbf{30}_1$. Any of the adjacent pairs 60 could be used for illustration purposes, though it should be appreciated that the page stations 30 will generally be loaded from a downstream page station to an upstream page station. For example, pages will be stored or buffered in a sequence beginning with page station $\mathbf{30}_{10}$ (see FIG. 3) and continue, as buffer stations are needed, until page station $\mathbf{30}_1$ is occupied. Furthermore, the page stations 30 will be unloaded on a "first in first out" (FIFO) basis. Hence, if pages 12 are buffered so as to fill stations $\mathbf{30}_{10}$ through $\mathbf{30}_4$, then pages will be released or unbuffered from page station $\mathbf{30}_{10}$ to page station $\mathbf{30}_4$ until the page buffer is empty and can, once again, buffer pages.

The page buffer 20 can be operated in various operational modes and controlled by driving the pairs of rollers $\mathbf{60}_1$, $\mathbf{60}_2$ independently. In FIGS. 4*a*-4*c*, each of the pairs $\mathbf{60}_1$, $\mathbf{60}_2$ are driven by a drive motor M which is responsive to signals received from the system controller 34. In the illustrated embodiment, only one of the rollers is shown as being driven by the motor M, though either or both of the rolling elements of a pair $\mathbf{60}_1$ or $\mathbf{60}_2$ may be driven. In FIG. 4*a*, the system controller 34 drives the motors M such that the downstream pair $\mathbf{60}_2$ retains and holds a leading edge portion 12L of a printed page 12 while upstream pair $\mathbf{60}_1$ holds the remaining portion of the printed page 12. Consequently, both motors M are driven in unison to cause the printed page 12 to traverse from the nip of one pair $\mathbf{60}_2$ to the nip of the adjacent pair $\mathbf{60}_1$.

In FIG. 4*b*, the controller 34 holds the downstream pair of rollers $\mathbf{60}_2$ stationary, i.e., issues a stop signal to the motor M, while driving the upstream pair of rollers $\mathbf{60}_1$. As a result, the leading edge portion 12L is captured within the nip of the downstream pair of rollers $\mathbf{60}_2$ while the trailing edge portion 12T continues to be driven by the upstream pair $\mathbf{60}_1$. Furthermore, the printed page 12 begins to bend and/or buckle about its midportion 12M. To ensure that the printed page 12 buckles in a downward direction toward the page station $\mathbf{30}_1$, an arcuate guide 70 having a downwardly projecting concave surface 70CS may be interposed between the pairs $\mathbf{60}_1$, $\mathbf{60}_2$. More specifically, the concave surface 70CS is spatially positioned to intersect or interrupt the feed path FP of the printed page 12 so as to guide the midportion 12M thereof in the desired downward direction.

In FIG. 4*c*, the printed page 12 is buffered or stored within the page station $\mathbf{30}_1$. While buffered, the leading edge portion 12L is captured within the nip of the downstream pair of rollers $\mathbf{60}_2$ while the upstream pair $\mathbf{60}_1$ has driven and released the trailing edge portion 12T of the page 12. The printed page 12, therefore, droops below the feed path FP in a predominantly vertical orientation. While buffered pages 12 may simply droop unsupported below the rollers $\mathbf{60}_1$, $\mathbf{60}_2$, the preferred embodiment includes a plurality of trays 80 for supporting the trailing edge portion 12T of each buffered page 12. The support tray 80 may be coupled to any fixed or stationary structure of the page buffer 20 or to the rotational axis 62A-1 supporting the lower roller of the pair $\mathbf{60}_2$.

In addition to providing a page station support, the tray 80 may additionally provide an inclined surface 80N for guiding the leading edge 12L of the printed page 12. That is, the inclined surface 80N may be spatially and angularly adapted to guide the leading edge 12L into the nip of the downstream pair of rollers $\mathbf{60}_2$. Furthermore, the upward inclination of the guide surface 80N may offset any downward inclination of the leading edge caused by the concave surface 70CS of the arcuate guide 70.

Figure 5A:
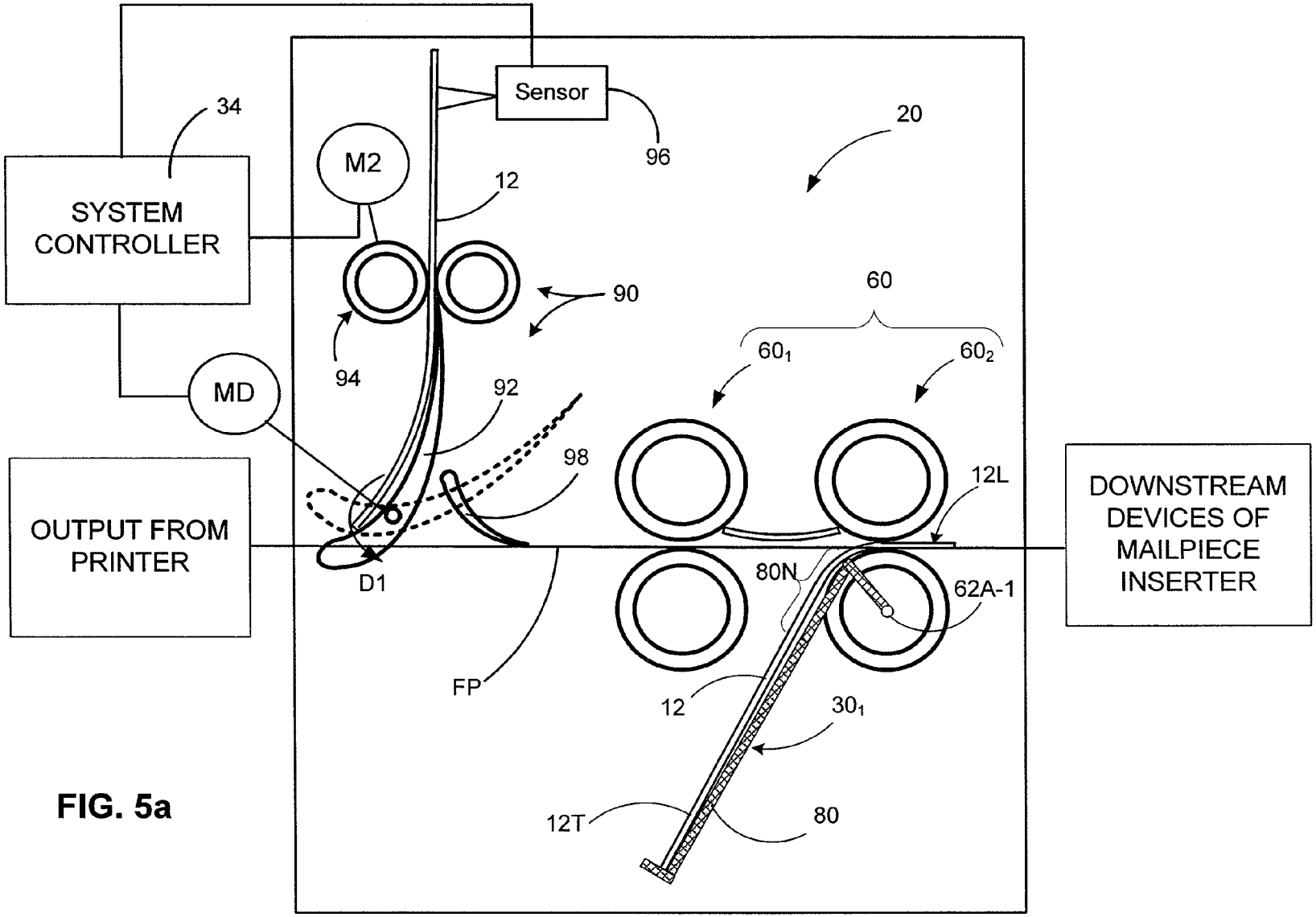
FIGS. 5*a* and 5*b* depict schematic side views of the page buffer including an inversion mechanism operative to direct pages from the printer to a pair of horizontal rollers to change the orientation of the sheet material, i.e., from a face-up to face down orientation, when preparing pages for processing.
Figure 5B:
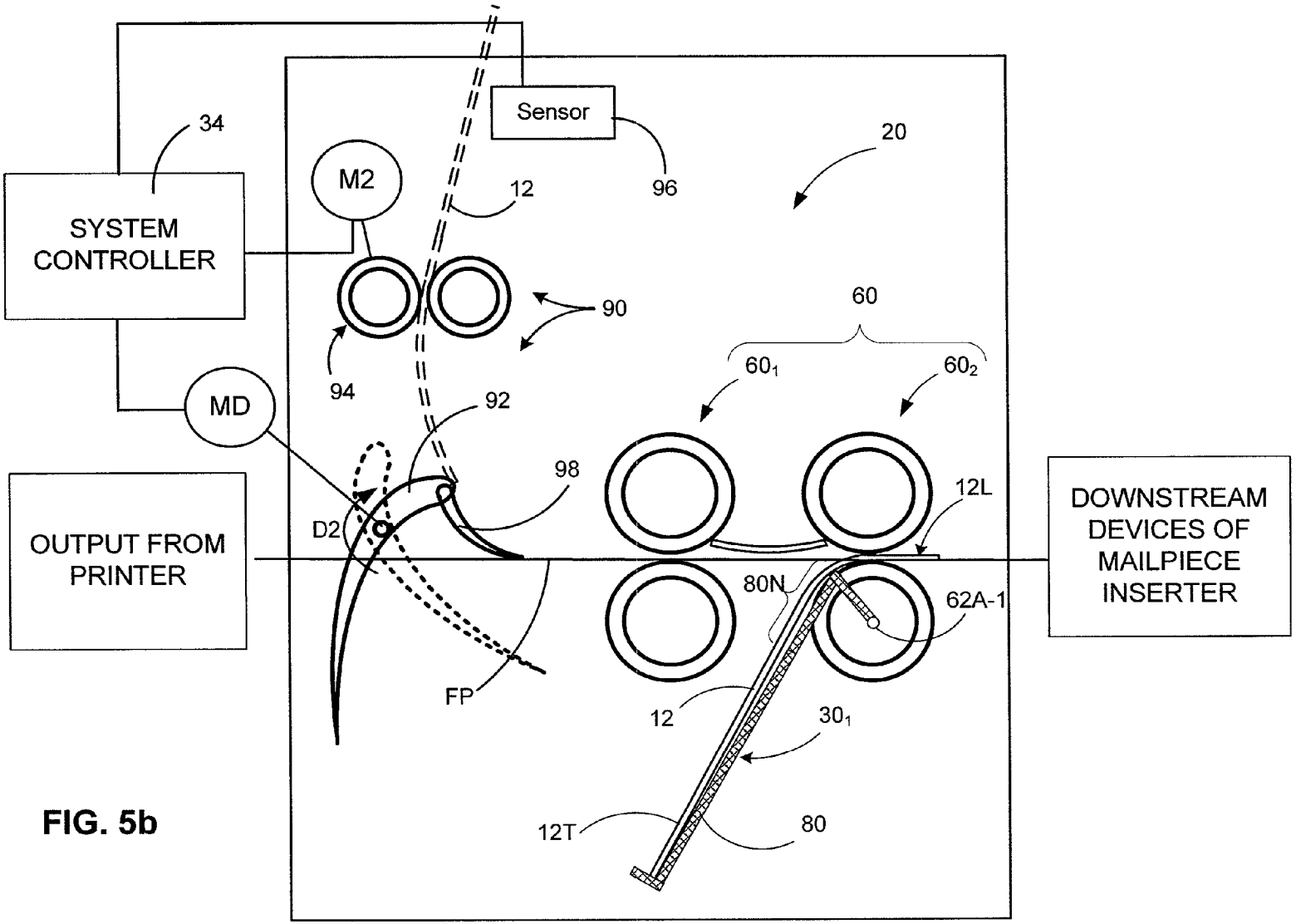

In FIGS. 5*a* and 5*b*, a sheet handling mechanism 90 is incorporated upstream of the vertically oriented pairs $\mathbf{60}_1$ to invert printed pages 12 from a face-up to face down orientation. The sheet handling or inversion mechanism 90 includes a movable or positionable diverter 92 which may be rotated counterclockwise in the direction of arrow D1 from a ready position (shown in dashed lines) to an operational position (shown in solid lines). In the ready position, printed pages 12 by-pass the inversion mechanism 90 and pass directly to the vertically-aligned pairs of rollers 60. In the operational position, the movable diverter 92 interposes the feed path FP to direct printed pages 12 from the printer output to a pair of horizontally-aligned rollers 94.

The horizontally-aligned rollers 94 may extend above or below the feed path FP and are operative to accept, momentarily hold, and return the printed pages to the original or primary feed path. More specifically, the rollers 94 rotate in a first direction to accept a printed page. When the nip of the horizontal pair 94 rotates through threshold angular displacement, or when a leading edge sensor 96 (see FIG. 5*b*) detects the vertical position of the printed page 12, the movable diverter rotates in a clockwise direction D2 to urge the trailing edge of the printed page toward a second or return diverter 98. As shown, the return diverter 98 is a fixed position guide, though it too can be movable or positionable. When the trailing edge 12T is suitably positioned relative to or above the return diverter 98, the pair of horizontal rollers 94 returns the printed page to the primary feed path FP between the vertically-aligned pairs of rollers 60. The printed page 12 is now inverted or face-down relative to its original face-up orientation.

While the inverter mechanism 90 may be controlled by a dedicated microprocessor, in the described embodiment, the system controller 34 issues and receives signals from the various driven components. For example, the controller 34 may be operative to drive a rotary actuator MD connected to the movable diverter 92, control a drive motor M2 associated with the horizontally aligned rollers 94 and receive/process signals from the leading edge sensor 96.

Figure 6:
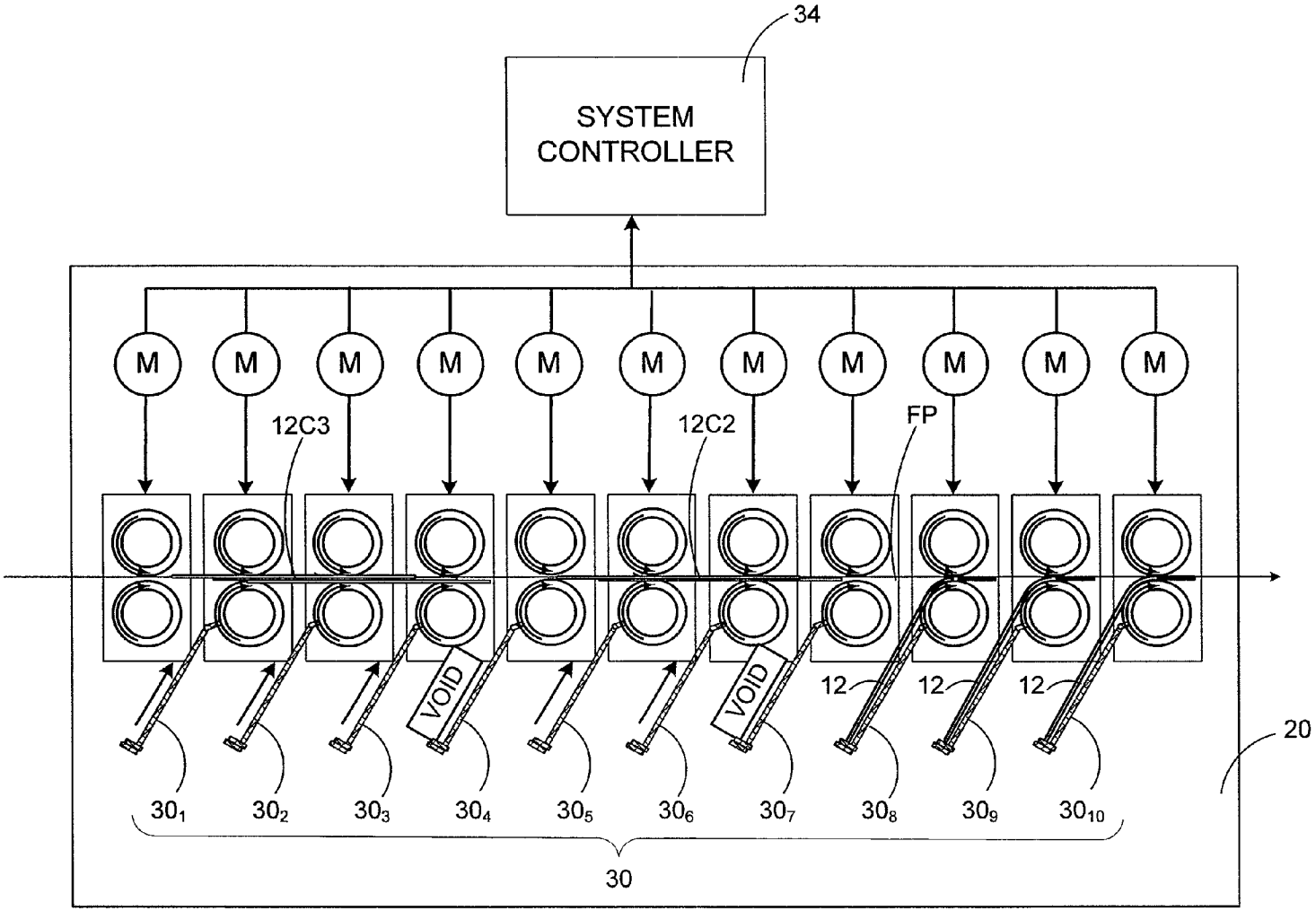
FIG. 6 depicts a schematic side view of the page buffer according to the present invention wherein the rollers are controlled to sequentially gather and shingle upstream elements of the content material to increase throughput of mailpieces created by the fabrication system.

In FIG. 6, the page buffer 20 may be adapted to fill, hold and release pages 12 within select page stations 30. In the embodiment depicted in the FIG. 6, the system controller 34 has filled all of the page stations 30 with the exception of page stations $\mathbf{30}_4$ and $\mathbf{30}_7$. Determining whether a page station 30 is filled or void will depend upon a variety of factors, however, one example may involve whether a mailpiece has one or several printed sheets. Using this example, a first mailpiece may have three (3) sheets of printed content material and may have been buffered in stations $\mathbf{30}_1$, $\mathbf{30}_2$, and $\mathbf{30}_3$. A second mailpiece may have two (2) sheets of printed content material and may have been buffered in stations $\mathbf{30}_5$, and $\mathbf{30}_6$. A third mailpiece may have one (1) sheet of printed content material and may have been buffered in station $\mathbf{30}_8$. Fourth and fifth mailpieces may also each have a single sheet which may have been buffered in stations $\mathbf{30}_9$ and $\mathbf{30}_{10}$, respectively. Stations $\mathbf{30}_4$ and $\mathbf{30}_7$ may be been left void to provide spacing between the buffered sheets 12.

The system controller 34 may drive the individual motors M to first remove, in sequential order, the pages 12 in page stations $\mathbf{30}_8$, $\mathbf{30}_9$ and $\mathbf{30}_{10}$ to fulfill the fabrication of three individual mailpieces. Thereafter, the system controller 34 may drive the motors associated with stations $\mathbf{30}_5$, $\mathbf{30}_6$, though, the printed page in station $\mathbf{30}_5$ may be released first to shingle with the leading edge of the page in station $\mathbf{30}_6$, thereby creating a two sheet collation 12C2. The system controller 34 then drives all motors M in connection with stations $\mathbf{30}_6$, $\mathbf{30}_7$, $\mathbf{30}_8$, $\mathbf{30}_9$, and $\mathbf{30}_{10}$ for conveying the two sheet collation 12C2 along the feed path FP. The system controller 34 then drives all motors M in connection with stations $\mathbf{30}_1$, $\mathbf{30}_2$, $\mathbf{30}_3$, releasing the pages in reverse order i.e., stations $\mathbf{30}_3$, $\mathbf{30}_2$, and $\mathbf{30}_1$, to shingle the pages into a three sheet collation 12C3. Finally, all of the drive motors M are activated to convey the final collated group 12C3 along the feed path FP. Accordingly, the page buffer 20 can be controlled in a variety of ways to buffer and release pages 12, individually or as a group to increase throughput, or accelerate collation in the accumulator module 35 of the mailpiece inserter 10.

In summary, the page buffer 20 of the present invention provides multiple page stations within a low-profile, space-efficient design envelope. Whereas prior art configurations employed sequential end-to-end page stations, the present invention employs vertically-oriented face-to-face pages stations. These vertically-oriented page stations provide a unique opportunity to minimize the overall length requirements of the page buffer 20. Furthermore, the page buffer 20 can be operated efficiently with or without the requirement to buffer pages. That is, the closely-spaced rollers and nips allow the page buffer to operate efficiently as a linear transport, but also provide the opportunity to buffer the printed pages as required. The relatively short distance between the input and output of the page buffer 20 reduces the speed and, consequently, the noise, generated by the driving motors, i.e., the motors which drive the transport and buffering rollers 60. Furthermore, such reduced speed requirements translate into reduced power requirements.

Finally, the page buffer 20 provides other operational modes which reduce complexity and facilitate throughput. The vertically-oriented pairs 60 simplify assembly and provide commonality of components. As such, fabrication and maintenance costs are minimized. Furthermore, the linear arrangement of rolling elements facilitates the ability to invert sheets from a face-up to face down orientation. Finally, such linear arrangement enables the grouping and/or shingling of sheets 12 internally of the page buffer 20 to transport a collation of sheets 12 along the feed path. Such grouping of printed pages enables higher system throughput by transporting a plurality of sheets while minimizing the spacing therebetween.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

The invention claimed is:

1. A page buffer for holding, in queue, pages prepared by a printer and for subsequent processing by mailpiece inserter, comprising:

pairs of vertically-aligned rollers defining a plurality of page stations therebetween, each pair being spaced-apart and defining a nip for driving the printed pages from one pair to another pair along a feed path, each page station defined by and between a first pair of rollers disposed downstream of an adjacent second pair;

a drive means for independently driving the pairs of vertically-aligned rollers;

a controller operative to control the drive means such that, in a first operating mode, the pairs cooperate to drive printed pages along the feed path, and in a second operating mode, at least one of the page stations causes the first pair to retain a leading edge portion of a printed page while the second pair drives and releases a trailing edge portion of the printed page, the printed page being buffered within the page station such that the trailing edge droops below the feed path in a predominantly vertical orientation.

2. The page buffer according to claim 1 wherein the page stations are arranged in tandem from an upstream station proximal to the printer to a downstream station nearest the mailpiece inserter, and wherein page stations are sequentially filled from the downstream page stations to the upstream page stations.

3. The page buffer according to claim 2 wherein printed pages are released from the page stations upon receipt by the page buffer of a page request signal from the mailpiece inserter, and wherein the controller is operative to control the drive means such that, in a third operating mode, upstream pages stations are caused to release printed pages so that the printed pages are shingled and transported as a group to the mailpiece inserter.

4. The page buffer according to claim 1 wherein the pages are printed on each side thereof and further comprising:

an inverter disposed upstream of the vertically-aligned rollers and operative to invert the printed page from a side facing up when exiting the printer to a side facing down when entering the vertically aligned rollers.

5. The page buffer according to claim 4 wherein the inverter includes at least one pair of horizontally-aligned rollers, the horizontally aligned rollers disposed upstream of the vertically aligned rollers and to a side of the feed path, the horizontally-aligned rollers defining a nip therebetween for accepting and transporting the printed pages;

a first diverter positionable from a ready position to allow printed pages from the printer to pass to the vertically aligned rollers and to an operational position to direct printed pages from the printer to the nip of the horizontally-aligned rollers, a second operative to direct printed pages from the nip of the horizontally aligned rollers to the vertically aligned rollers.

6. The page buffer according to claim 1 further comprising a guide structure for guiding the leading edge of a printed page into the nip of the first pair of rollers.

7. The page buffer according to claim 6 further comprising an arcuate guide structure disposed between the first and second pairs of rollers of each page station and operative to bow the printed page in a downward direction.

8. The page buffer according to claim 1 further comprising a support tray proximal to the first pair of rollers of each page station and operative to support the trailing edge of a printed page.

9. The page buffer according to claim 1 further comprising a support tray proximal to the first pair of rollers of each page station and operative to support the trailing edge of a printed page, the support tray further defining a guide surface for guiding the leading edge of a printed page into the nip of the first pair of rollers.

10. The page buffer according to claim 1 wherein printed pages are released from the page stations upon receipt by the page buffer of a page request signal from the mailpiece inserter, and wherein the controller is operative to control the drive means such that upstream page stations are caused to release printed pages from the page buffer to the mailpiece inserter.

11. A method for operating a page buffer for a desktop inserter having a printer integrated with a mailpiece inserter, the page buffer interposed between the printer and mailpiece inserter and operative to receive and hold, in a queue, printed pages for subsequent processing, comprising the steps of:

providing a page buffer having pairs of independently driven, vertically-aligned rollers, each pair being spaced-apart and defining a nip for driving the printed pages from one pair to another pair along the feed path, the pairs, furthermore defining a plurality of page stations therebetween, each page station defined by and between a first pair of rollers disposed downstream of an adjacent second pair;

driving the rollers of a page station such that the leading edge of the printed page engages the nip of the first pair of rollers and the trailing edge of the printed page is in the second pair of rollers; and holding the first pair of rollers stationary while driving the second pair of rollers until the trailing edge portion disengages the nip of the second pair;

whereby the page buffer retains the printed page in a predominantly vertical orientation as a consequence of holding the leading edge within the nip of the first pair and allowing the trailing edge to droop below the feed path.

12. A page buffer for holding sheet material along a feed path, comprising:

pairs of vertically-aligned rollers defining a plurality of page stations therebetween, each pair being spaced-apart and defining a nip for driving the printed pages from one pair to another pair along the feed path, each page station defined by and between a first pair of rollers disposed downstream of an adjacent second pair;

a drive means for independently driving the pairs of vertically-aligned rollers;

a controller operative to control the drive means such that at least one of the page stations causes the first pair to retain a leading edge portion of a printed page while the second pair drives and releases a trailing edge portion of the printed page, the printed page being buffered within the page station such that the trailing edge droops below the feed path in a predominantly vertical orientation.

13. The page buffer according to claim 12 wherein the page stations are arranged in tandem from an upstream station to a downstream station, and wherein page stations are sequentially filled from the downstream to upstream stations.

14. The page buffer according to claim 12 further comprising a guide structure for guiding the leading edge of a printed page into the nip of the first pair of rollers.

15. The page buffer according to claim 14 further comprising an arcuate guide structure disposed between the first and second pairs of rollers of each page station and operative to bow the printed page in a downward direction.

16. The page buffer according to claim 12 further comprising a support tray proximal to the first pair of rollers of each page station and operative to support the trailing edge of a printed page.

17. The page buffer according to claim 12 further comprising further comprising a support tray proximal to the first pair of rollers of each page station and operative to support the trailing edge of a printed page, the support tray further defining a guide surface for guiding the leading edge of a printed page into the nip of the first pair of rollers.

18. The method according to claim 11 wherein printed pages are released from the page stations upon receipt by the page buffer of a page request signal from the mailpiece inserter, and wherein the controller is operative to control the drive means such that upstream page stations are caused to release printed pages from the page buffer to the mailpiece inserter.

19. The method according to claim 11 further including the step of:

guiding an upper face surface of the printed page in downward direction to cause the trailing edge to droop below the feed path.

20. The method according to claim 11 further including the step of:

guiding the leading edge portion of the printed page into the first pair of each page station.

21. The method according to claim 11 wherein the page stations are arranged in tandem from an upstream station proximal to the printer to a downstream station nearest the mailpiece inserter, and further comprising the step of sequentially buffering the page stations from the downstream to upstream stations.

22. The method according to claim 21 wherein printed pages are released from the page stations upon receipt by the page buffer of a page request signal from the mailpiece inserter, and further comprising the step of releasing printed pages from the upstream page stations so that the printed pages are shingled and transported as a group to the mailpiece inserter.

23. The page buffer according to claim 12 wherein printed pages are released from the page stations upon receipt by the page buffer of a page request signal from the mailpiece inserter, and wherein the controller is operative to control the drive means such that upstream page stations are caused to release printed pages from the page buffer to the mailpiece inserter.

* * * * *